US012037765B2

(12) United States Patent
Okazaki

(10) Patent No.: US 12,037,765 B2
(45) Date of Patent: Jul. 16, 2024

(54) CONSTRUCTION MACHINE

(71) Applicant: Yanmar Power Technology Co., Ltd., Osaka (JP)

(72) Inventor: Kohei Okazaki, Chikugo (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 390 days.

(21) Appl. No.: 17/440,918

(22) PCT Filed: Jan. 31, 2020

(86) PCT No.: PCT/JP2020/003672
§ 371 (c)(1),
(2) Date: Sep. 20, 2021

(87) PCT Pub. No.: WO2020/189049
PCT Pub. Date: Sep. 24, 2020

(65) Prior Publication Data

US 2022/0162830 A1 May 26, 2022

(30) Foreign Application Priority Data

Mar. 20, 2019 (JP) ..... 2019-053264

(51) Int. Cl.
*E02F 3/00* (2006.01)
*E02F 3/815* (2006.01)
*E02F 3/84* (2006.01)

(52) U.S. Cl.
CPC ..... *E02F 3/847* (2013.01); *E02F 3/815* (2013.01)

(58) Field of Classification Search
CPC ..... E02F 3/847; E02F 3/815
USPC ..... 701/50
See application file for complete search history.

(56) References Cited

U.S. PATENT DOCUMENTS

2005/0274879 A1 12/2005 Osaragi et al.
2013/0275035 A1* 10/2013 Taylor ..... E02F 9/2045 701/300

FOREIGN PATENT DOCUMENTS

| | | | |
|---|---|---|---|
| JP | 2-153123 | A | 6/1990 |
| JP | 027952/1994 | U | 4/1994 |
| JP | 6-173292 | A | 6/1994 |
| JP | 9-028112 | A | 2/1997 |
| JP | 11-236713 | A | 8/1999 |

(Continued)

OTHER PUBLICATIONS

International Search Report dated Apr. 7, 2020 issued in corresponding PCT Application PCT/JP2020/003672.

*Primary Examiner* — Tiffany P Young
(74) *Attorney, Agent, or Firm* — NORTON ROSE FULBRIGHT US LLP

(57) ABSTRACT

A turning work vehicle includes a lower travel body, an upper turning body, a work device, a rotation body, and a support column. The lower travel body is provided with a blade. The upper turning body is supported by the lower travel body so as to be able to turn. The work device is supported by the upper turning body so as to be able to rotate. The rotation body is provided to the blade. The support column projects from the rotation body. A target prism, which is the measurement object of a total station, can be secured to the support column. The rotation body rotates in relation to the blade, whereby the posture of the support column is configured so as to be able to switch between an upright posture and a fallen posture.

4 Claims, 9 Drawing Sheets

(56) References Cited

FOREIGN PATENT DOCUMENTS

| | | | | |
|---|---|---|---|---|
| JP | 2003-004528 | A | 1/2003 | |
| JP | 2005-337741 | A | 12/2005 | |
| JP | 2018-048451 | A | 3/2018 | |
| WO | WO-2011107096 | A1 * | 9/2011 | ..... E02F 3/7609 |

* cited by examiner

CONSTRUCTION MACHINE

CROSS-REFERENCE TO RELATED APPLICATIONS

This application is a national stage application pursuant to 35 U.S.C. § 371 of International Application No. PCT/JP2020/003672, filed on Jan. 31, 2020 which claims priority under 35 U.S.C. § 119 to Japanese Patent Application No. 2019-053264 filed on Mar. 20, 2019, the disclosures of which are hereby incorporated by reference in their entireties.

TECHNICAL FIELD

The present invention relates to a construction machine.

BACKGROUND ART

There are conventionally known construction machines including a blade (earth removal plate). Patent Literatures 1 and 2 disclose this type of construction machine.

A bulldozer in Patent Literature 1 may automatically control a blade by an automatic tracking survey device (total station). With this configuration, a pole is provided to be upright on the blade, and a prism is provided as a tracking target on the pole. The survey device emits laser light and detects light reflected by the prism. As a result, the coordinate position of the blade is measured.

A hydraulic excavator in Patent Literature 2 is configured to have a reflector member, which reflects light such as light of a vehicle, provided on an earth removal plate. An upper turning body of the hydraulic excavator includes a front device. The hydraulic excavator may perform dirt excavating work, or the like, by the front device while moving the front device by the turning of the upper turning body.

CITATION LIST

Patent Literature

Patent Literature 1: Japanese Unexamined Patent Application Publication No. 11-236713

Patent Literature 2: Japanese Unexamined Patent Application Publication No. 2018-48451

DISCLOSURE OF INVENTION

Problems to be Solved by the Invention

In recent years, for example, in the construction industry, there has been an increasing demand for information-based construction that aims to improve productivity and ensure quality through the use of electronic information. Therefore, it is considered desirable to enable automatic control of the level of the earth removal plate in the hydraulic excavator in Patent Literature 2.

However, if the configuration of Patent Literature 1 is applied to the hydraulic excavator of Patent Literature 2, the prism, which is provided on the earth removal plate via the pole, would be located in a considerably high position. Therefore, the position of the prism and the position of part of the pole are likely to be included in the working area of the front device. Therefore, when the hydraulic excavator works by using the front device, the front device may interfere with the prism and the part of the pole and may damage these members.

In order to avoid damage to the prism, the front device, and the like, the operator may remove the prism and the pole from the earth removal plate when the hydraulic excavator is not using the earth removal plate. However, this process causes an increase in man-hours and raises a burden on the operator.

The present invention has been made in consideration of the above circumstances, and its object is to provide a construction machine capable of avoiding damage to a device and reducing a burden on an operator.

Means for Solving the Problems

The problems to be solved by the present invention have been described above, and means for solving the problems and an effect thereof will be described below.

According to an aspect of the present invention, a construction machine having the configuration below is provided. Specifically, the construction machine includes a lower travel body, an upper turning body, a work device, a rotation body, and a support column. The lower travel body includes an earth removal plate. The upper turning body is supported by the lower travel body to be turnable. The work device is rotatably supported by the upper turning body. The rotation body is provided on the earth removal plate. The support column is provided to protrude from the rotation body. A light receiving device, which is a measurement target of a distance and angle measurement device, is fixable to the support column. The support column is configured such that a posture thereof is switched between an upright posture and a lying posture due to rotation of the rotation body relative to the earth removal plate.

This enables desired measurement by the distance and angle measurement device while the support column is in the upright posture when a work is conducted by the earth removal plate using the light receiving device. On the other hand, when the light receiving device is not used during a work, the support column is set in the lying posture so as to avoid interference with a work by the work device, for example. Accordingly, the operation of attaching/removing the support column may be omitted, which may result in a reduction in the labor of the operator.

In the construction machine described above, it is preferable to include a protrusion member that is provided to protrude rearward from the earth removal plate and support the rotation body.

Thus, by using the protrusion member, it is possible to stably support the rotation body, the support column, and thus the light receiving device on the earth removal plate. Furthermore, as the rotation body and the support column are located behind the earth removal plate, it is possible to achieve a layout that is less likely to interfere with earth removal work.

In the construction machine described above, it is preferable to have the configuration below. Specifically, the construction machine includes a work device position acquisition unit, a restriction device, an upright posture detection unit, and a control unit. The work device position acquisition unit acquires position information on the work device. The restriction device restricts an operation of the work device. The upright posture detection unit detects whether the posture of the support column is the upright posture. When the upright posture detection unit detects that the posture of the support column is the upright posture, the control unit activates the restriction device based on the position information on the work device acquired by the work device position acquisition unit.

Accordingly, when the posture of the support column is the upright posture, the restriction device is activated to restrict an operation of the work device so as to avoid the work device from interfering with the support column. Thus, it is possible to prevent damage to the support column, and the like, due to interference with the work device. Furthermore, for example, when the work device is sufficiently separated from the support column, or the like, the operation of the work device is not restricted, which avoids an excessive reduction in the work efficiency of the work device.

DESCRIPTION OF EMBODIMENTS

Figure 1:
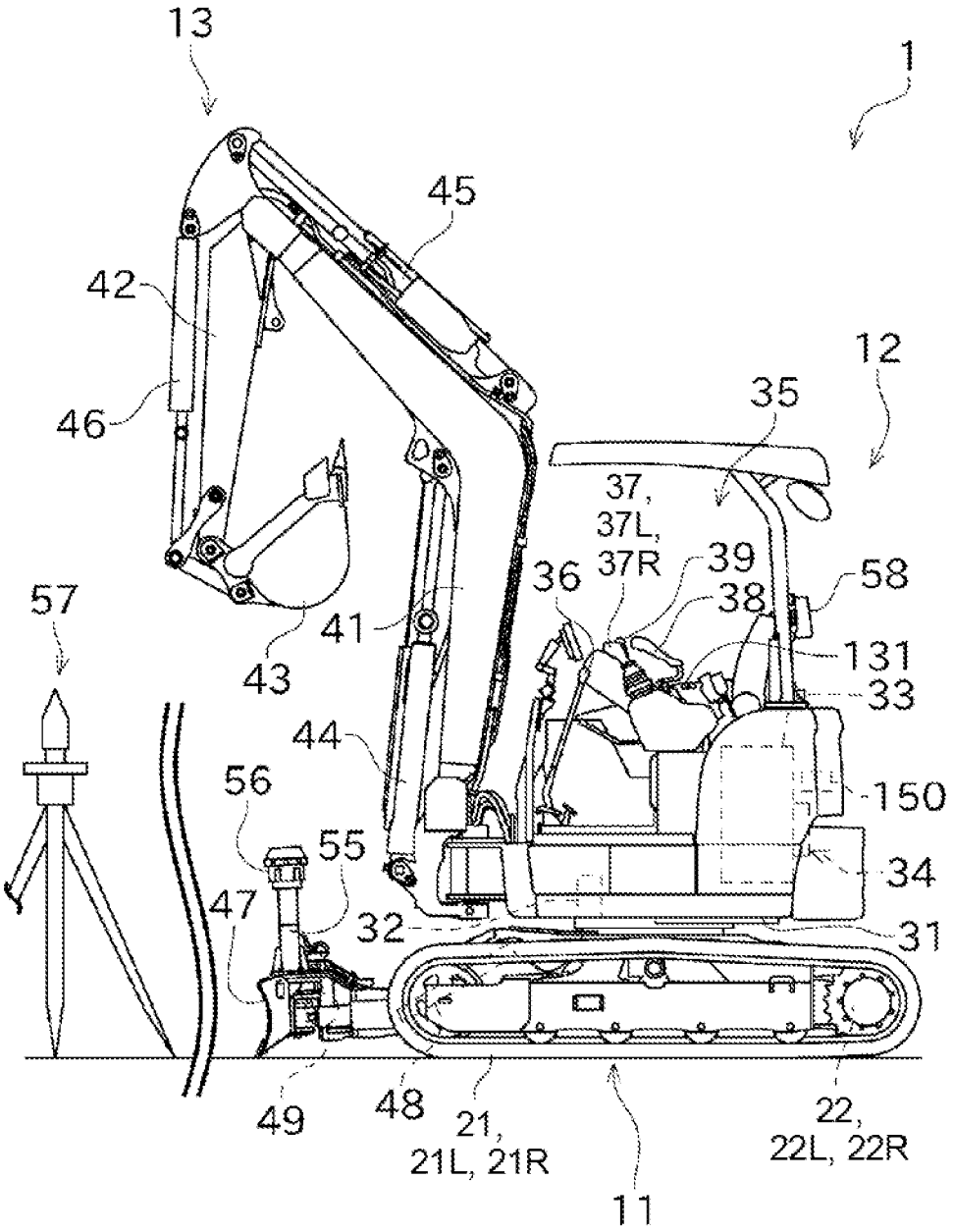
FIG. 1 is a side view illustrating an overall configuration of a turning work vehicle according to an embodiment of the present invention.

Next, an embodiment of the present invention will be described with reference to the drawings. FIG. 1 is a side view illustrating an overall configuration of a turning work vehicle 1 according to an embodiment of the present invention.

The turning work vehicle (blade work machine, construction machine) 1 illustrated in FIG. 1 includes a lower travel body 11 and an upper turning body 12.

The lower travel body 11 includes a crawler travel device 21 and a hydraulic motor 22. The pair of crawler travel devices 21 and the pair of hydraulic motors 22 are provided on the right and left sides, respectively.

Each of the crawler travel devices 21 includes an endless crawler that is made of, for example, rubber. The crawler is wound around a sprocket, and the sprocket is coupled to an output shaft of the hydraulic motor 22 provided on the same side as the crawler travel device 21.

Each of the hydraulic motors 22 is configured to rotate forward and backward so as to allow the turning work vehicle 1 to move forward and backward. The hydraulic motors 22 on the right and left sides are configured to be driven individually so as to enable the straight moving of the turning work vehicle 1 and the traveling with steering, etc.

The upper turning body 12 includes a turning frame 31, a turning motor 32, an engine 33, a hydraulic pump unit 34, a driving unit 35, and a work device 13.

The turning frame 31 is provided above the lower travel body 11 and is supported by the lower travel body 11 so as to rotate around a vertical axis. The turning motor 32 allows the turning frame 31 to rotate relative to the lower travel body 11. The engine 33 is configured as for example a diesel engine. The hydraulic pump unit 34 is driven by the engine 33 to generate the oil pressure necessary for traveling and working of the turning work vehicle 1.

The driving unit 35 includes various operating members. The operating members include a pair of travel operation levers 36 and a pair of work operation levers 37, which are provided on the right and left sides, and the like. The operator may operate the above-described operating members to give various instructions to the turning work vehicle 1.

The work device 13 includes a boom 41, an arm 42, a bucket 43, and a blade (earth removal plate) 47. Furthermore, the work device 13 includes, as actuators, a boom cylinder 44, an arm cylinder 45, a bucket cylinder 46, a blade lift cylinder 48, and a blade tilt cylinder 49.

The boom 41 is configured as an elongated member, and a proximal end portion thereof is rotatably supported by a front portion of the turning frame 31. The boom cylinder 44 is attached to the boom 41 so that the boom cylinder 44 expands and contracts so as to rotate the boom 41.

The arm 42 is configured as an elongated member, and a proximal end portion thereof is rotatably supported by a distal end portion of the boom 41. The arm cylinder 45 is attached to the arm 42 so that the arm cylinder 45 expands and contracts so as to rotate the arm 42.

The bucket 43 is configured as a container-shaped member, and a proximal end portion thereof is rotatably supported by a distal end portion of the arm 42. The bucket cylinder 46 is attached to the bucket 43 so that the bucket cylinder 46 expands and contracts so as to rotate the bucket 43 and perform a scooping/dumping operation.

The blade 47 is provided to extend in a vehicle body width direction (right-left direction). The blade 47 is provided in front of the lower travel body 11.

The blade 47 is supported so as to rotate relative to the lower travel body 11 around an axis extending in the right-left direction. The blade lift cylinder 48 is attached to the blade 47 so that the blade lift cylinder 48 expands and contracts so as to lift and lower the blade 47. Furthermore, the blade tilt cylinder 49 is attached to the blade 47 so that the blade tilt cylinder 49 expands and contracts so as to tilt the blade 47 around an axis parallel to the direction in which the turning work vehicle 1 moves in a straight line.

According to the present embodiment, the boom cylinder 44, the arm cylinder 45, the bucket cylinder 46, the blade lift cylinder 48, and the blade tilt cylinder 49 all include hydraulic cylinders. These hydraulic cylinders expand and contract due to the hydraulic power generated by the hydraulic pump unit 34.

A support column 55 is attached to an upper portion of the blade 47, and a target prism (light receiving device) 56 is fixed to an upper end of the support column 55. The target prism 56 includes a 360° prism so as to reflect light in a direction parallel to incident light even if the light is incident in any direction. The target prism 56 is the target whose position is measured by a total station 57 described below.

The total station (distance and angle measurement device) 57 is installed at a work site or an appropriate position near it. The total station 57 is configured as a known electronic distance and angle measurement device using light to measure the vertical angle, the horizontal angle, and the distance at which the target prism 56 is located. Based on the measurement result, the three-dimensional coordinates of the target prism 56 may be calculated. The total station 57 is configured as an automatic tracking type and has a function to automatically track changes in the position of the target prism 56. The total station 57 acquires changes in the position in real time while tracking the target prism 56.

The turning work vehicle 1 includes an antenna 58 that may communicate with the total station 57 via wireless communication. The turning work vehicle 1 side may receive the position of the target prism 56 in real time from the total station 57.

Figure 2:
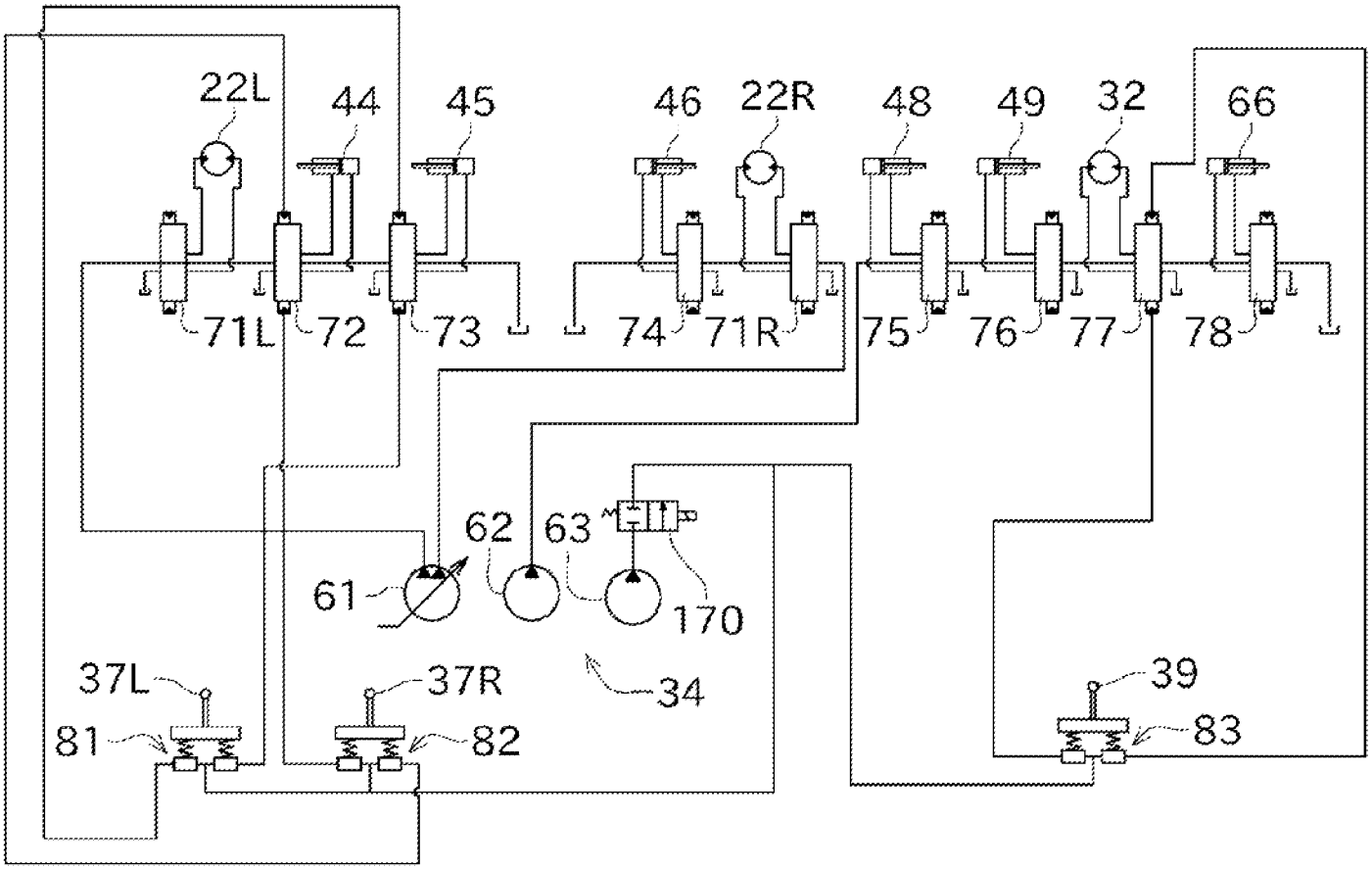
FIG. 2 is a diagram schematically illustrating a hydraulic circuit of the turning work vehicle.

Next, a hydraulic circuit provided in the turning work vehicle 1 is described. FIG. 2 is a diagram schematically illustrating the hydraulic circuit of the turning work vehicle 1. Reference numerals 21L, 21R, 22L, 22R, 37L, 37R may be used below to identify the crawler travel devices 21, the hydraulic motors 22, and the work operation levers 37 on the right and left sides.

As illustrated in FIG. 2, the hydraulic pump unit 34 includes a variable-capacity first hydraulic pump 61, a fixed-capacity second hydraulic pump 62, and a fixed-capacity third hydraulic pump 63.

The first hydraulic pump 61 is coupled to the hydraulic motor 22L, the boom cylinder 44, and the arm cylinder 45 on the left side. Direction switching valves 71L, 72, 73 are each provided between a first discharge port of the first hydraulic pump 61 and the hydraulic motor 22L, the boom cylinder 44, and the arm cylinder 45.

The first hydraulic pump 61 is coupled to the hydraulic motor 22R and the bucket cylinder 46 on the right side. Direction switching valves 71R, 74 are provided between a second discharge port of the first hydraulic pump 61 and the hydraulic motor 22R and the bucket cylinder 46, respectively.

The second hydraulic pump 62 is coupled to the blade lift cylinder 48, the blade tilt cylinder 49, the turning motor 32, and a boom swing cylinder 66. Direction switching valves 75, 76, 77, 78 are provided between a discharge port of the second hydraulic pump 62 and the blade lift cylinder 48, the blade tilt cylinder 49, the turning motor 32, and the boom swing cylinder 66, respectively.

The left work operation lever 37L may give an instruction to rotate the arm 42. The right work operation lever 37R may give an instruction to rotate the boom 41. A turning operation lever 39 may give an instruction to turn the upper turning body 12. For example, the left work operation lever 37L may also be used as the turning operation lever 39.

The turning work vehicle 1 includes remote control valves 81, 82 provided corresponding to the work operation levers 37L, 37R on the right and left. Each of the remote control valves 81, 82 includes two output ports so as to feed hydraulic oil at the pressures corresponding to the amounts of operation to the ports corresponding to the respective operations of the work operation levers 37L, 37R on the right and left.

Pilot pressures output from the remote control valves 81, 82 are led to pilot ports of the direction switching valves 73, 72, respectively. In other words, the remote control valves 81, 82 may feed hydraulic oil at pressures (pilot pressures) corresponding to the respective operations of the work operation levers 37L, 37R on the right and left.

Accordingly, spools of the direction switching valves 73, 72 are displaced in the direction and the amount corresponding to the rotational state instructed by the work operation levers 37L, 37R on the right and left, respectively. This allows the arm cylinder 45 and the boom cylinder 44 to expand and contract in accordance with the operator's instruction. Thus, the work device 13 may be operated.

Each of the other direction switching valves 71, 74 to 78 is coupled to a remote control valve, as is the case with the direction switching valves 73, 72 described above. When the operator operates an operating member such as the travel operation lever 36, the pilot pressure output from the remote control valve is changed, and thus the spools of the direction switching valves 71, 74 to 78 are displaced to switch feeding/stopping of the hydraulic oil. This allows the hydraulic motors 22L, 22R, the bucket cylinder 46, the blade lift cylinder 48, the blade tilt cylinder 49, the turning motor 32, and the boom swing cylinder 66 to be driven in accordance with the operator's instruction.

If a description is given by using an example, as illustrated in FIG. 2, a remote control valve 83 is coupled to the direction switching valve 77. When the operator operates the turning operation lever 39, the pilot pressure output from the remote control valve 83 is changed, and thus the spool of the direction switching valve 77 is displaced to switch feeding/stopping of the hydraulic oil. This allows the turning motor 32 to be driven in accordance with the operator's instruction. Thus, the upper turning body 12 may be turned.

Figure 3:
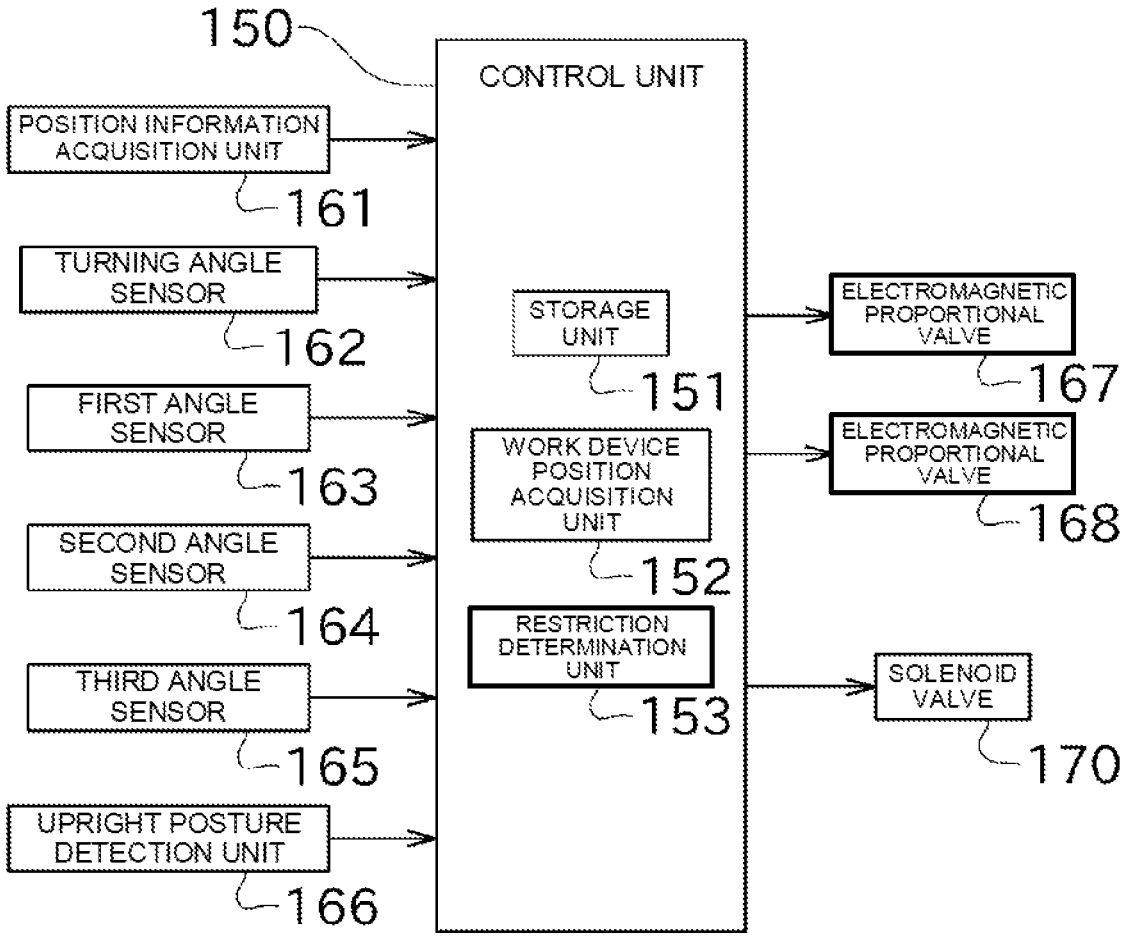
FIG. 3 is a block diagram illustrating an electrical configuration for controlling an operation of a work device.

Next, a configuration for acquiring position information on the blade 47 included in the turning work vehicle 1 is described. FIG. 3 is a block diagram illustrating an electrical configuration for controlling an operation of the work device 13.

The turning work vehicle 1 includes a control unit 150 illustrated in FIG. 3. The control unit 150 is configured as a known computer including a CPU, a storage device, an input/output unit, and the like, which are not illustrated. The CPU may read and execute various programs, and the like, from the storage device. The storage device stores various types of programs and data.

Furthermore, the turning work vehicle 1 also includes a position information acquisition unit 161 that acquires position information on the blade 47. According to the present embodiment, the position information acquisition unit 161 includes a wireless receiver that wirelessly receives the position of the target prism 56 from the total station 57 using the antenna 58.

The position information acquisition unit 161 outputs the position information on the blade 47 to the control unit 150. The position information on the blade 47 is three-dimensional position information including the distance to the target (the target prism 56) provided for the blade 47, the horizontal angle of the direction in which the target exists relative to the reference direction, and the vertical angle of the direction in which the target exists relative to the reference level.

The control unit 150 determines the position of a lower end portion of the blade 47 based on the position of the target prism 56. Then, the control unit 150 compares the position of the blade lower end portion with the design information previously set in the control unit 150. The design information is information describing the level of a finished surface by the blade 47 in three dimensions.

The control unit 150 controls the blade lift cylinder 48 so as to, for example, lower the blade 47 when the level of the blade lower end portion is higher than the finished surface in the design information and so as to lift the blade 47 when it is lower than the finished surface. This control is performed when the control unit 150 outputs a control signal indicating the degree of opening to electromagnetic proportional valves 167, 168 that adjust the pilot pressures for moving the spools of the direction switching valves 75, 76. However, the electromagnetic proportional valves 167, 168 are omitted from the hydraulic circuit diagram of FIG. 2.

Figure 4:
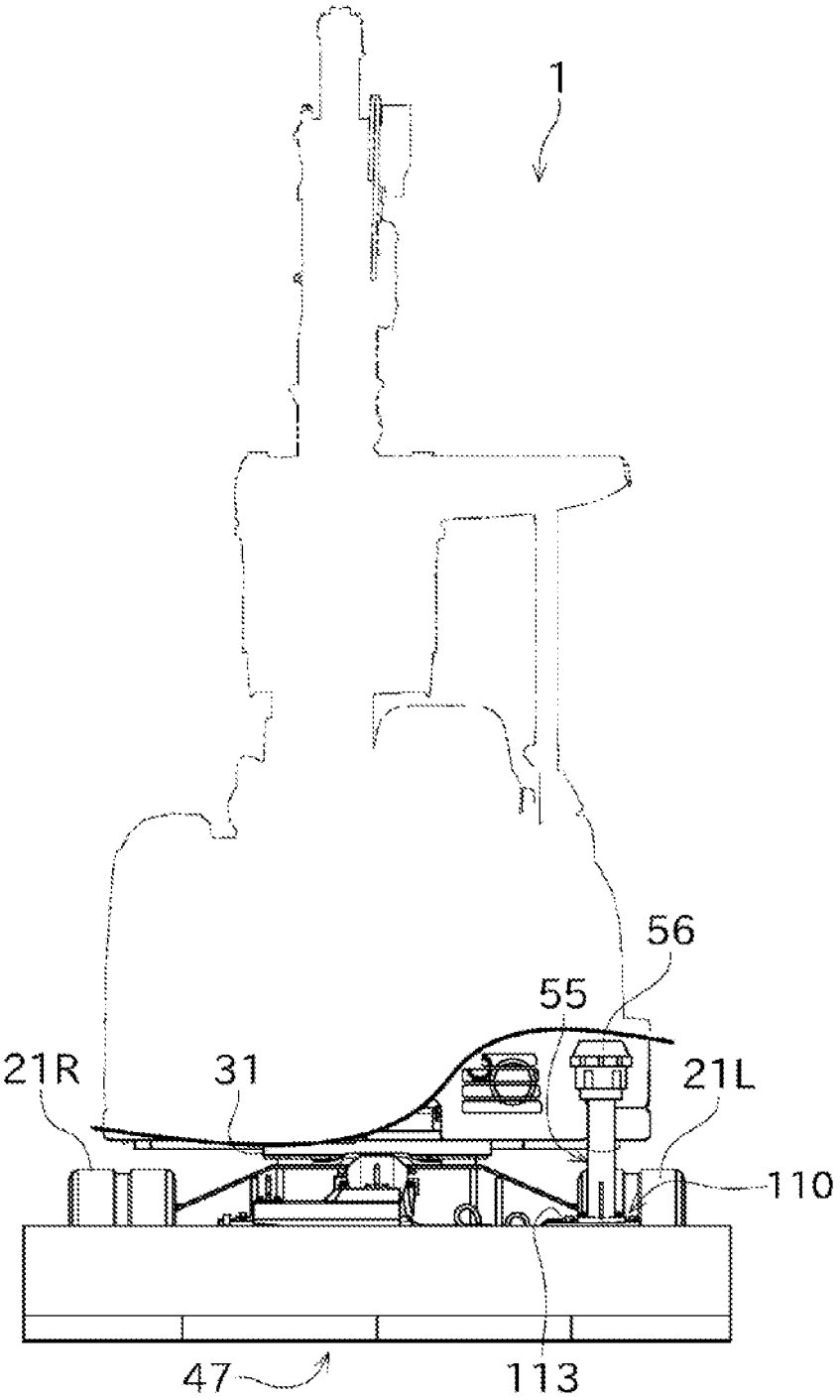
FIG. 4 is a front view illustrating a configuration near a blade when a support column is in an upright posture.
Figure 5:
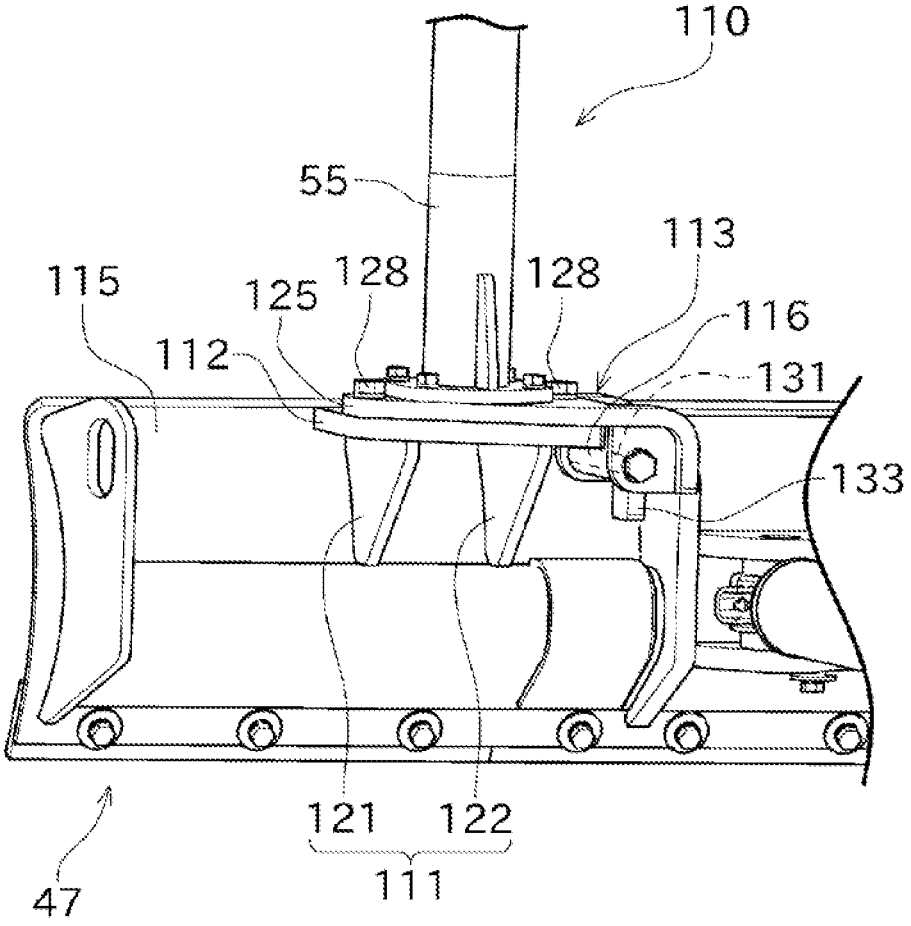
FIG. 5 is a rear perspective view illustrating a configuration near the blade when a posture of the support column is the upright posture.
Figure 6:
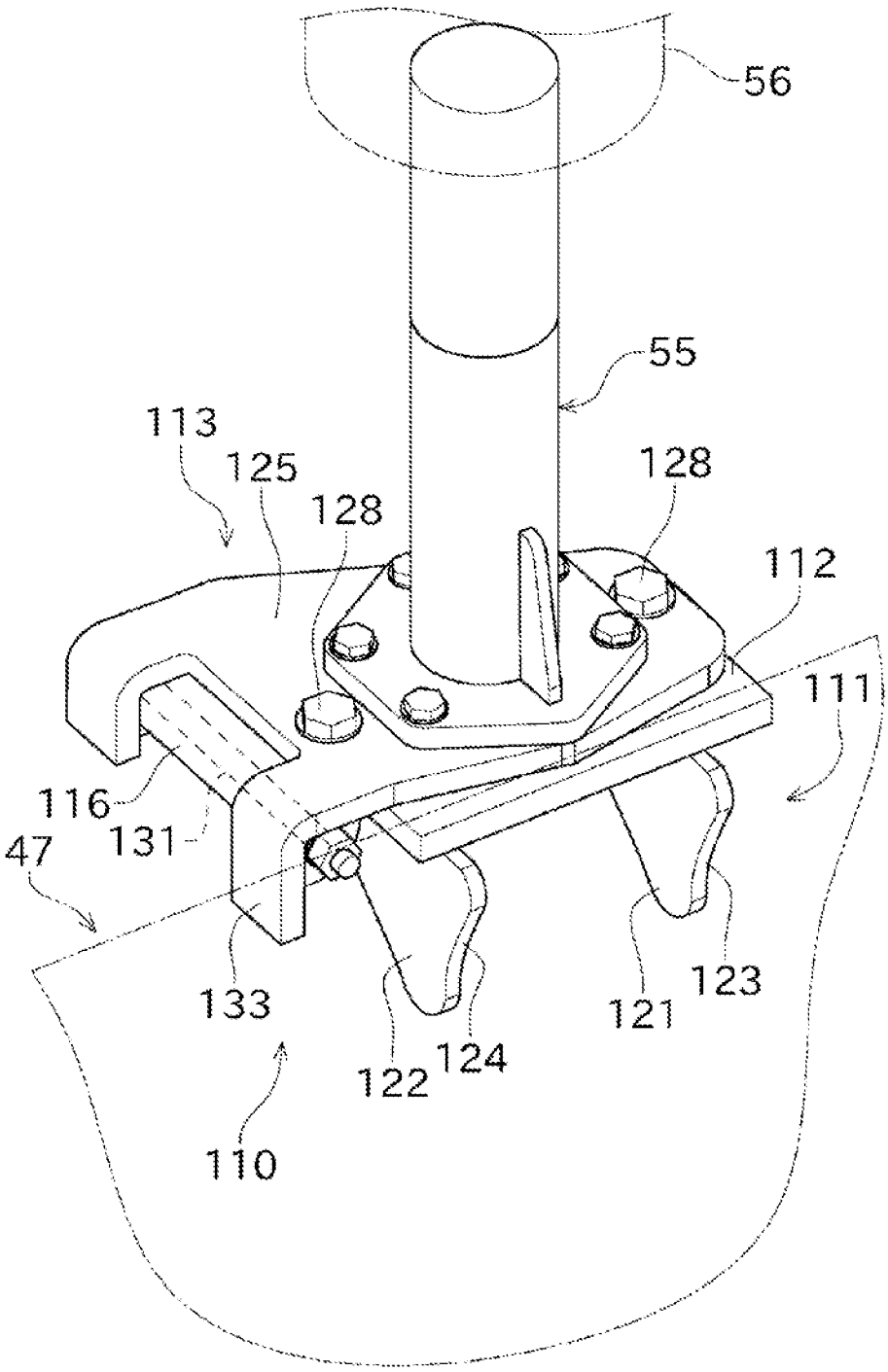
FIG. 6 is a front perspective view illustrating a configuration of a rotation body, the support column, and the like, when the posture of the support column is the upright posture.
Figure 7:
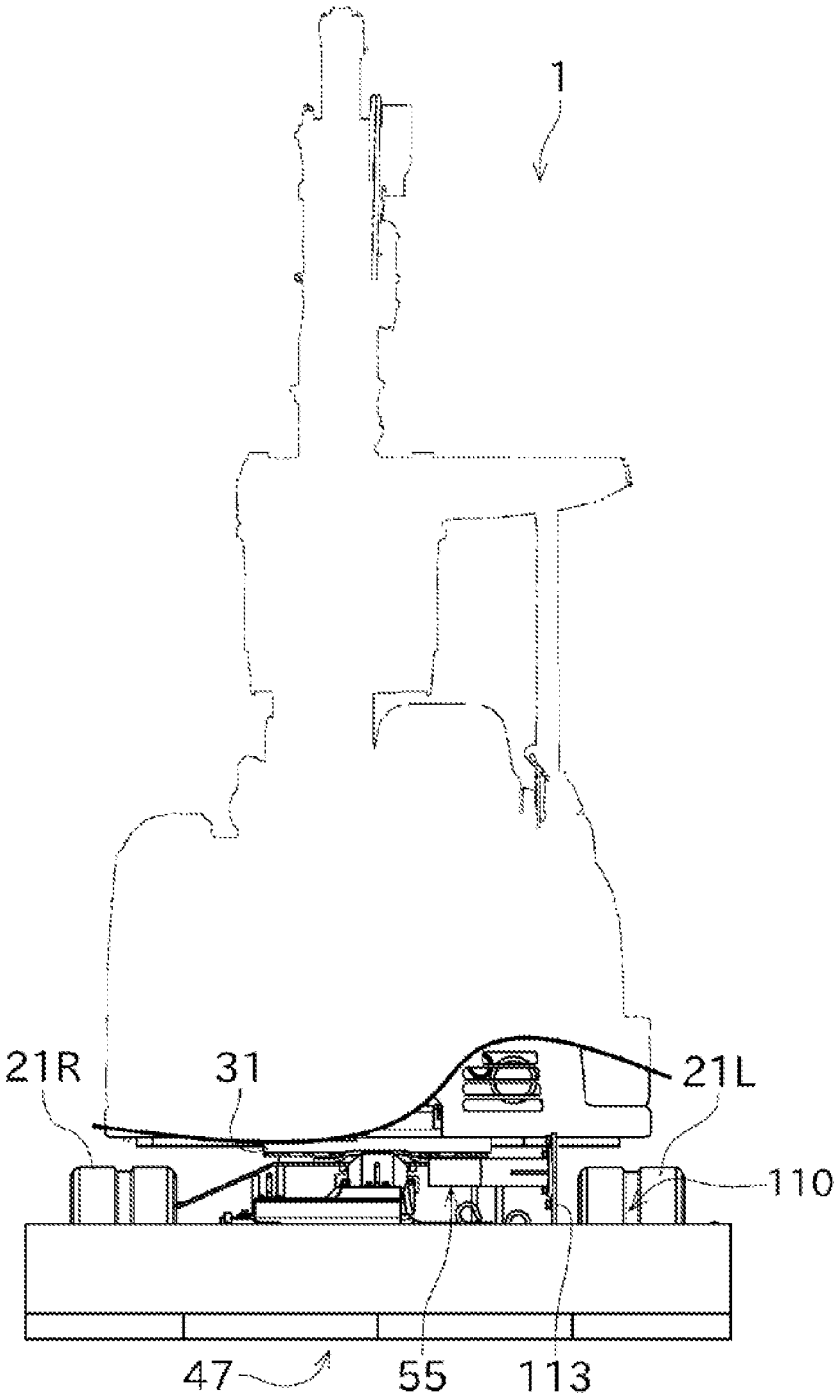
FIG. 7 is a front view illustrating a configuration near the blade when the posture of the support column is a lying posture.
Figure 8:
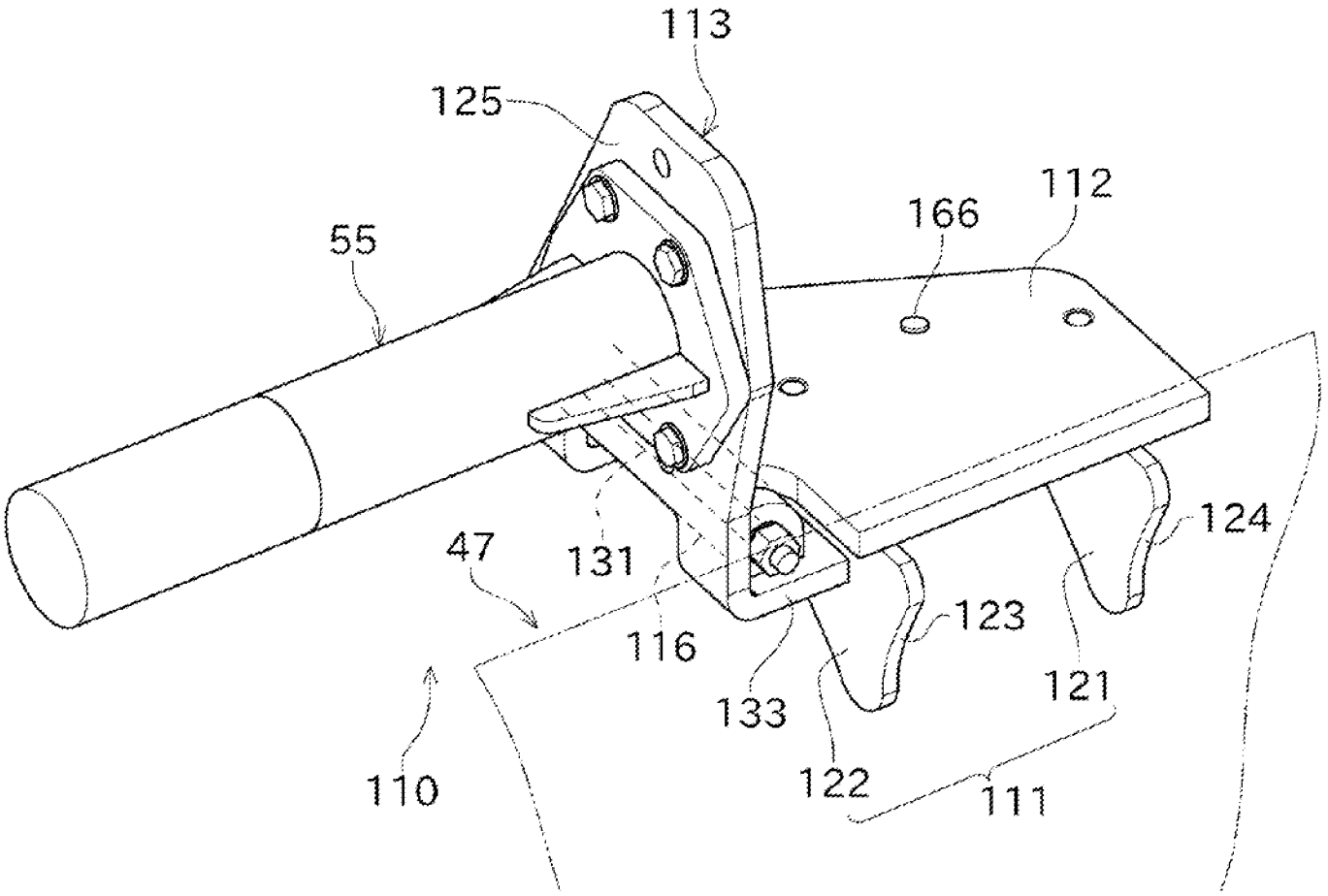
FIG. 8 is a front perspective view illustrating a configuration of the rotation body, the support column, and the like, when the posture of the support column is the lying posture.

Next, a configuration for attaching the target prism 56 to the blade 47 is described in detail with reference to FIGS. 4 to 8. FIG. 4 is a front view illustrating a configuration near the blade 47 when the posture of the support column 55 is an upright posture. FIG. 5 is a rear perspective view illustrating a configuration near the blade 47 when the posture of the support column 55 is the upright posture. FIG. 6 is a front perspective view illustrating a configuration of a rotation body 113, the support column 55, and the like, when the posture of the support column 55 is the upright posture. FIG. 7 is a front view illustrating a configuration near the blade 47 when the posture of the support column 55 is a lying posture. FIG. 8 is a front perspective view illustrating a configuration of the rotation body 113, the support column 55, and the like, when the posture of the support column 55 is the lying posture.

As illustrated in FIG. 4, the target prism 56 is attached to the blade 47 via a mounting member 110 so as to be positioned above the blade 47.

As illustrated in FIG. 5, the mounting member 110 is attached to a back surface 115 of the blade 47. The mounting member 110 is located, in the right-left direction, at a position shifted to the right or left side of the blade 47 from the horizontal center portion thereof. According to the present embodiment, the mounting member 110 is provided in front of the left crawler device 21L included in the crawler devices 21L, 21R on the right and left.

As illustrated in FIGS. 5 and 6, the mounting member 110 includes a protrusion member 111, a support body 112, the rotation body 113, and the support column 55.

The protrusion member 111 is provided to protrude rearward from the back surface 115 of the blade 47, as illustrated in FIG. 5. The protrusion member 111 includes a first fixing piece 121 and a second fixing piece 122. The first fixing piece 121 and the second fixing piece 122 are provided with a predetermined gap interposed in the right-left direction.

A front portion 123 of the first fixing piece 121 is fixed to the back surface 115 of the blade 47. Similarly, a front portion 124 of the second fixing piece 122 is fixed to the back surface 115 of the blade 47. Respective upper end portions of the first fixing piece 121 and the second fixing piece 122 are located near an upper end portion of the blade 47.

The support body 112 is attached to the blade 47 via the protrusion member 111. The support body 112 is fixed to the protrusion member 111 and the blade 47 by welding in such a manner that it is placed on top of the protrusion member 111. The support body 112 is located behind the blade 47 and near the upper end portion of the blade 47.

The support body 112 is formed like a rectangular flat plate. The support body 112 is provided such that its thickness direction extends along the vertical direction. The support body 112 is provided so as to overlap with the blade 47 (the turning work vehicle 1) when the blade 47 is viewed from the front.

A rotation support portion 116 is fixed to the support body 112. The rotation support portion 116 is provided at one horizontal end portion of the support body 112 (specifically, the right end portion that is the end portion closer to the horizontal center of the blade 47). The rotation support portion 116 is configured as a cylindrical member. A rotation shaft 131 described below is inserted into a shaft hole of the rotation support portion 116.

The rotation body 113 is rotatably supported by the support body 112. As a result, the rotation body 113 is rotatable relative to the blade 47 around an axis oriented in a front-back direction. This rotation allows the rotation body 113 to move between a first rotational position illustrated in FIGS. 4 and 6 and a second rotational position illustrated in FIGS. 7 and 8.

Specifically, the rotation shaft 131 is attached to a placement portion 125. The rotation shaft 131 is inserted into the rotation support portion 116 included in the support body 112. This allows the placement portion 125 (in other words, the rotation body 113) to rotate relative to the support body 112 and thus the blade 47 around the rotation shaft 131. This allows positional switching between the first rotational position and the second rotational position.

When the rotation body 113 is in the first rotational position, the rotation body 113 is placed on top of the support body 112. When the rotation body 113 is in the second rotational position, the rotation body 113 is separated from the support body 112.

The rotation body 113 includes the placement portion 125 formed like a flat plate. When the rotation body 113 is in the first rotational position, the placement portion 125 is parallel to the support body 112 and is in contact with an upper surface of the support body 112. The above-described support column 55 is mounted on the placement portion 125. The support column 55 is formed like an elongated cylinder and is provided so as to be perpendicular to the placement portion 125. The support column 55 protrudes farther from the support body 112.

The placement portion 125 is fixed to the support body 112 with a fastening member 128, such as a bolt, while placed on top of the support body 112. This may prevent the rotation body 113 from rotating unexpectedly due to vibration, etc. Removal of the fastening member 128 allows the rotation body 113 to be displaced relative to the support body 112 so as to be in the second rotational position.

The placement portion 125 is provided with an L-shaped stopper portion 133. The stopper portion 133 is in contact with the second fixing piece 122 when the placement portion 125 is rotated approximately 90° from the first rotational position. This restriction causes the rotation body 113 to be set in the second rotational position.

An end portion of the support column 55 on one side in the longitudinal direction is fixed to the placement portion 125 of the rotation body 113. Accordingly, the support column 55 may rotate together with the rotation body 113. The target prism 56 is provided at the end portion of the support column 55 on the opposite side of the rotation body 113.

With this configuration, when the rotation body 113 is in the first rotational position, the support column 55 is in an upright posture to project upward from the rotation body 113, as illustrated in FIG. 4. When the rotation body 113 is in the second rotational position, the support column 55 is in a lying posture to project rightward from the rotation body 113, as illustrated in FIG. 7.

When the support column 55 is in the upright posture, the support column 55 projects upward with respect to the blade 47, as illustrated in FIGS. 4 to 6. When the support column 55 is in the lying posture, the support column 55 is oriented parallel to the direction (right-left direction) in which the blade 47 extends, as illustrated in FIGS. 7 and 8.

The length of the support column 55 may be set to any length in consideration of the visibility, or the like, of the target prism 56 based on the total station 57. Furthermore, as the target prism 56 is often removed from the turning work vehicle 1 when not in use, the length of the support column 55 is preferably set such that the support column 55 does not extend beyond the horizontal width of the blade 47 when in the lying posture. Of course, the length of the support column 55 may be set such that the target prism 56 does not fall beyond the horizontal width of the blade 47 even in the lying posture with the target prism 56 attached to the support column 55.

According to the present embodiment, the rotation body 113 (the placement portion 125) is fixed to the support body 112 with the fastening member 128 as described above while the support column 55 is in the upright posture, and thus the support column 55 may be prevented from moving relative to the blade 47.

Although not illustrated, the support column 55 is configured to be fixed to the blade 47 even in the lying posture. A fixing structure may be, but not limited thereto, a known structure using a lock pin, for example.

With the above configuration, the rotation body 113 is rotated relative to the support body 112 (the blade 47) so that the posture of the support column 55 may be switched between the upright posture and the lying posture. Switching of the posture of the support column 55 may be performed while the target prism 56 is attached to the support column 55.

When information-based construction is performed using the turning work vehicle 1, the support column 55 is fixed in the upright posture. Accordingly, the target prism 56 is positioned substantially above the blade 47, and therefore the position of the target prism 56 may be acquired by the total station 57 in a desirable manner. The turning work vehicle 1 automatically changes the level of the blade 47 by the above-described control based on the result of comparison between the three-dimensional position of the target prism 56 and the design information previously set for the turning work vehicle 1. This makes it possible to conduct a work by smoothing using the blade 47 in a desirable manner.

On the other hand, when the automatic control is not executed on the blade 47, the posture of the support column 55 is switched from the upright posture to the lying posture. Accordingly, it is possible to conduct a work by the work device 13 while avoiding interference between the work device 13 and the support column 55.

The rotation body 113 and the support column 55 are attached to the protrusion member 111 that is provided to protrude rearward from the blade 47. The protrusion member 111 (the first fixing piece 121 and the second fixing piece 122), together with the support body 112, are fixed to the back surface 115 of the blade 47 by welding. As a result, in such a layout that the support column 55, and the like, are located behind the blade 47, the support column 55 is unlikely to interfere with earth removal work regardless of whether the posture of the support column 55 is the upright posture or the lying posture.

Furthermore, the turning work vehicle 1 may perform a process to prevent the work device 13 from interfering with the support column 55 when the work device 13 operates while the support column 55 is in the upright posture. A configuration for this process is described below.

As illustrated in FIG. 3, the control unit 150 includes a storage unit 151, a work device position acquisition unit 152, and a restriction determination unit 153.

As described above, the control unit 150 includes the CPU, and the like, and an ROM stores various programs. By the cooperation of the hardware and software described above, the control unit 150 may be operated as the storage unit 151, the work device position acquisition unit 152, the restriction determination unit 153, and the like, illustrated in FIG. 3.

The storage unit 151 may store restriction position information regarding a restriction area of the work device 13. The restriction position information is previously defined to be near the support column 55 based on the position of the support column 55 in the upright posture.

The work device position acquisition unit 152 may acquire the position information on the work device 13. According to the present embodiment, the work device position acquisition unit 152 calculates and acquires the position information on the work device 13 based on the turning angle of the upper turning body 12, the rotation angle of the boom 41, the rotation angle of the arm 42, and the rotation angle of the bucket 43, acquired by the control unit 150. Specifically, the position information on the work device 13 may be, but not limited thereto, the three-dimensional coordinates of a distal end portion of the bucket 43.

The restriction determination unit 153 may determine whether the operation of the work device 13 needs to be restricted based on the restriction position information stored in the storage unit 151 and the work device position information acquired by the work device position acquisition unit 152.

As illustrated in FIG. 3, a turning angle sensor 162, a first angle sensor 163, a second angle sensor 164, a third angle sensor 165, and an upright posture detection unit 166 are coupled to the control unit 150, as well as the above-described position information acquisition unit 161. Furthermore, a solenoid valve 170, which corresponds to a restriction device, is coupled to the control unit 150.

The turning angle sensor 162 may detect the turning angle of the upper turning body 12. The first angle sensor 163 may detect the rotation angle of the boom 41. The second angle sensor 164 may detect the rotation angle of the arm 42. The third angle sensor 165 may detect the rotation angle of the bucket 43. Each of the sensors 162, 163, 164, 165 outputs a detection signal to the control unit 150.

The upright posture detection unit 166 may detect that the support column 55 is in the upright posture. According to the present embodiment, the upright posture detection unit 166 includes a pressure-type switch. The upright posture detection unit 166 is provided on the support body 112 so as to project upward, as illustrated in FIG. 8. When the support column 55 is in the upright posture, a contact included in the upright posture detection unit 166 is pressed from above by the rotation body 113. The upright posture detection unit 166 outputs, to the control unit 150, the detection signal indicating whether the contact is being pressed.

The solenoid valve 170 may restrict the operation of the work device 13. Specifically, the solenoid valve 170 may block the supply of the hydraulic oil fed from the third hydraulic pump 63 to the pilot ports of the direction switching valves 77, 72, 73 illustrated in FIG. 2 to stop the drive of the turning motor 32, the boom cylinder 44, and the arm cylinder 45. The solenoid valve 170 is provided between the third hydraulic pump 63 and the direction switching valves 77, 72, 73. The solenoid valve 170 is activated to be in an opened state or a closed state.

The solenoid valve 170 performs cutoff control. The solenoid valve 170 is in an opened state when a contact of a cutoff switch, which is not illustrated, is closed (when ON). Conversely, the solenoid valve 170 is in a closed state when the contact of the cutoff switch is opened (when OFF). The cutoff switch is switched between ON and OFF by an operation of a cutoff lever 38 included in the operating member. According to the present embodiment, the solenoid valve 170 is controlled to be closed not only when the cutoff switch is off but also when a predetermined condition described below is satisfied.

When the solenoid valve 170 is open, the hydraulic oil may be supplied from the third hydraulic pump 63 to the direction switching valve 77, and the pilot pressure may be applied to the direction switching valve 77. When the solenoid valve 170 is closed, the supply of the hydraulic oil from the third hydraulic pump 63 to the direction switching valve 77 is blocked. Accordingly, the pilot pressure is no longer applied to the direction switching valve 77 so that the turning of the upper turning body 12 by the turning motor 32 is substantially prevented. Similarly, when the solenoid valve 170 is closed, the pilot pressures are no longer applied to the direction switching valves 72, 73 so that the rotation of the boom 41 by the boom cylinder 44 and the rotation of the arm 42 by the arm cylinder 45 are substantially prevented.

Figure 9:
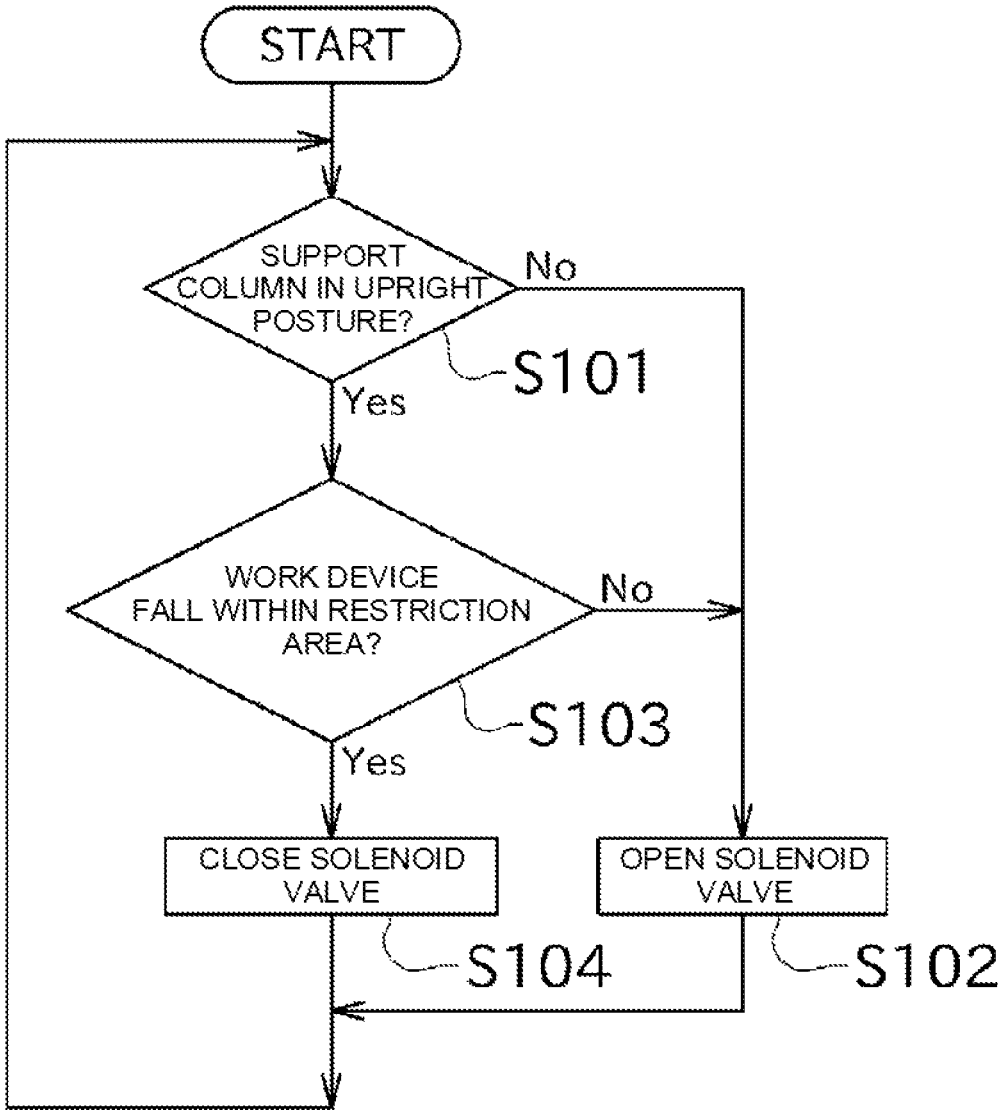
FIG. 9 is a flowchart illustrating a process for regulating an operation of the work device.

Next, with reference to FIG. 9, a process performed by the control unit 150 with respect to the solenoid valve 170 is described. FIG. 9 is a flowchart illustrating a process for regulating the operation of the work device 13.

When the process of FIG. 9 is started, the control unit 150 first determines whether the posture of the support column 55 is the upright posture based on the detection result of the upright posture detection unit 166 (Step S101). When the posture of the support column 55 is not the upright posture, the control unit 150 sets the solenoid valve 170 in the opened state (Step S102). Thereafter, the process returns to Step S101.

When the posture of the support column 55 is the upright posture as a result of determination at Step S101, the control unit 150 determines whether the position of the work device 13 falls within the restriction area (Step S103). When the position of the work device 13 falls within the restriction area, the control unit 150 sets the solenoid valve 170 in the closed state (Step S104). Thereafter, the process returns to Step S101.

When the position of the work device 13 does not fall within the restriction area, the control unit 150 sets the solenoid valve 170 in the opened state (Step S102). Thereafter, the process returns to Step S101.

By performing the above process, when the support column 55 is in the upright posture and the work device 13 is in the restriction area near the support column 55 (i.e., the target prism 56), the solenoid valve 170 is automatically closed so as to prevent operations such as the turning of the upper turning body 12 and the rotation of the boom 41. Accordingly, even when the operator forgets to lay the support column 55 and operates the work device 13, it is possible to prevent the bucket 43, or the like, from colliding with the target prism 56 and the support column 55.

As described above, the turning work vehicle 1 according to the present embodiment includes the lower travel body 11, the upper turning body 12, the work device 13, the rotation body 113, and the support column 55. The lower travel body 11 includes the blade 47. The upper turning body 12 is supported by the lower travel body 11 to be turnable. The work device 13 is rotatably supported by the upper turning body 12. The rotation body 113 is provided on the blade 47. The support column 55 is provided to protrude from the rotation body 113. The target prism 56, which is the measurement target of the total station 57, is fixable to the support column 55. The support column 55 is configured such that the posture thereof is switched between the upright posture and the lying posture due to the rotation of the rotation body 113 relative to the blade 47.

This enables desirable measurement by the total station 57 while the support column 55 is in the upright posture when a work is conducted by the blade 47 using the target prism 56. On the other hand, when the target prism 56 is not used during a work, the support column 55 is set in the lying posture so as to avoid interference with a work by the work device 13, for example. Accordingly, the operation of attaching/removing the support column 55 to/from the turning work vehicle 1 may be omitted, which may result in a reduction in the labor of the operator.

Furthermore, the turning work vehicle 1 according to the present embodiment includes the protrusion member 111. The protrusion member 111 is provided to protrude backward from the blade 47 and supports the rotation body 113.

Thus, by using the protrusion member 111, it is possible to stably support the rotation body 113, the support column 55, and thus the target prism 56 on the blade 47. Furthermore, as the rotation body 113 and the support column 55 are located behind the blade 47, it is possible to achieve a layout that is less likely to interfere with earth removal work.

Further, the turning work vehicle 1 according to the present embodiment includes the work device position acquisition unit 152, the solenoid valve 170, the upright posture detection unit 166, and the control unit 150. The work device position acquisition unit 152 acquires position information on the work device 13. The solenoid valve 170 restricts the operation of the work device 13. The upright posture detection unit 166 detects whether the posture of the support column 55 is the upright posture. When the upright posture detection unit 166 detects that the posture of the support column 55 is the upright posture, the control unit 150 sets the solenoid valve 170 in the closed state based on the position information on the work device 13 acquired by the work device position acquisition unit 152.

Accordingly, when the posture of the support column 55 is the upright posture, the solenoid valve 170 is set to the closed state to substantially prevent the drive of the turning motor 32, or the like, so as to avoid the work device 13 from interfering with the support column 55, or the like. Thus, it is possible to prevent damage to the target prism 56, the support column 55, and the like, due to interference with the work device 13. Furthermore, when the work device 13 has not entered the restriction area, the operation of the work device 13 is not restricted, which avoids an excessive reduction in the work efficiency of the work device 13.

Although a preferred embodiment of the present invention has been described above, the above-described configuration may be modified as described below for example.

According to the above embodiment, the rotation body 113 is provided on the blade 47 via the protrusion member 111 and the support body 112; however, the configuration for providing the rotation body 113 on the blade 47 is not particularly limited, and for example, the rotation body 113 may be provided on the blade 47 via a different member or may be directly provided on the blade 47.

According to the above embodiment, the support column 55 is provided to project from the rotation body 113 to the right side of the turning work vehicle 1 when in the lying posture; however, the support column 55 may also project from the rotation body 113 to the left side of the turning work vehicle 1.

The configuration for maintaining the posture of the support column 55 in the upright posture may also be realized using a component other than the fastening member 128, such as a lock pin. The configuration for maintaining the posture of the support column 55 in the lying posture may also be changed to an appropriate one.

According to the above embodiment, the turning motor 32, the boom cylinder 44, and the arm cylinder 45 are stopped when the position of the work device 13 falls within the restriction area. Alternatively, the boom cylinder 44, or the like, may be configured to automatically perform an avoidance operation. For example, it is assumed that the upper turning body 12 is turning due to the operator's operation in the turning work vehicle 1 where the support column 55 is not lying. The control unit 150 performs calculation based on the position of the work device 13 to determine whether the bucket 43 will collide with the target prism 56, or the like, if turning is continued. When there is a high possibility of the above-described collision, the control unit 150 performs control, e.g., automatically drives the boom cylinder 44, or the like, to lift the bucket 43 while continuously turning the upper turning body 12. This configuration also prevents damage to the target prism 56, etc.

The restriction of the operation of the work device 13 is not necessarily achieved by stopping the supply of the pilot pressure to the direction switching valve. For example, it is assumed that the turning work vehicle 1 includes a hydraulic turning brake that applies a brake to the turning of the upper turning body 12. This turning brake applies a brake using a spring force but may release the brake by supplying hydraulic pressure. During the normal operation, a hydraulic pump supplies hydraulic pressure to the turning brake and thus no brake is applied. On the other hand, when the position information on the work device 13 falls within the restriction area, the control unit 150 stops the supply of hydraulic pressure to the turning brake by using, for example, a solenoid valve. Thus, a brake is applied to the turning of the upper turning body 12, and the turning of the work device 13 is substantially prevented.

It may be determined whether the operation of the work device 13 is restricted in consideration of the speed, acceleration, or the like, of the work device 13 in addition to the current position of the work device 13.

It is apparent that many changes and modifications may be made to the present invention in consideration of the above-described teachings. Therefore, it should be understood that the present invention may be practiced in a manner other than that described herein within the scope of the appended claims.

DESCRIPTION OF REFERENCE NUMERALS

1 Turning work vehicle (construction machine)
11 Lower travel body
12 Upper turning body
13 Work device
47 Blade (earth removal plate)
55 Support column
56 Target prism (light receiving device)
57 Total station (distance and angle measurement device)
111 Protrusion member
113 Rotation body
150 Control unit
152 Work device position acquisition unit
166 Upright posture detection unit
170 Solenoid valve (restriction device)

The invention claimed is:

1. A construction machine comprising:
a lower travel body including an earth removal plate;
an upper turning body supported by the lower travel body and configured to be turnable;
a work device rotatably supported by the upper turning body;
a rotation body provided on the earth removal plate; and
a support column provided and configured to protrude from the rotation body, wherein
a light receiving device, which is a measurement target of a distance and angle measurement device, is fixable to the support column, and
the support column is configured such that a posture thereof is switched between an upright posture and a lying posture due to rotation of the rotation body relative to the earth removal plate.

2. The construction machine according to claim 1, comprising a protrusion member that is provided and configured to protrude rearward from the earth removal plate and support the rotation body.

3. The construction machine according to claim 1, comprising:
a work device position acquisition unit configured to acquire position information of the work device;
a restriction device configured to restrict an operation of the work device;
an upright posture detection unit configured to detect whether the posture of the support column is the upright posture; and
a control unit configured to, when the upright posture detection unit detects that the posture of the support column is the upright posture, activate the restriction device based on the position information of the work device acquired by the work device position acquisition unit.

4. The construction machine according to claim 2, comprising:
a work device position acquisition unit configured to acquire position information of the work device;
a restriction device configured to restrict an operation of the work device;
an upright posture detection unit configured to detect whether the posture of the support column is the upright posture; and
a control unit configured to, when the upright posture detection unit detects that the posture of the support column is the upright posture, activate the restriction device based on the position information of the work device acquired by the work device position acquisition unit.

* * * * *